US006058736A

United States Patent [19]

Keenan

[11] Patent Number: 6,058,736

[45] Date of Patent: May 9, 2000

[54] AIR SEPARATION PLANT

[75] Inventor: Brian Anthony Keenan, New Malden, United Kingdom

[73] Assignee: The BOC Group plc, Windlesham, United Kingdom

[21] Appl. No.: 09/131,961

[22] Filed: Aug. 11, 1998

[30] Foreign Application Priority Data

Aug. 15, 1997 [GB] United Kingdom ..... 9717349

[51] Int. Cl.[7] ..... F25J 3/04

[52] U.S. Cl. ..... 62/648; 62/653; 60/35.42

[58] Field of Search ..... 62/644, 648, 653, 62/915, 643; 60/39.12

[56] References Cited

U.S. PATENT DOCUMENTS 3,950,957 4/1976 Zakon ..... 62/644
4,224,045 9/1980 Olszewski et al. ..... 62/915
4,250,704 2/1981 Bruckner et al. ..... 60/39.12
4,382,366 5/1983 Gaumer ..... 62/915
5,081,845 1/1992 Allam et al. ..... 62/915
5,428,962 7/1995 Rieth ..... 62/653
5,806,340 9/1998 Tomita ..... 62/644
5,845,517 12/1998 Attlfellner ..... 62/644

*Primary Examiner*—William Doerrler
*Attorney, Agent, or Firm*—Salvatore P. Pace

[57] ABSTRACT

An air separation plant includes an air compressor, a gas turbine arranged to drive the air compressor, a product nitrogen compressor, and a steam turbine arranged to drive the product nitrogen compressor. The steam turbine forms part of a circuit including a steam generator in which stream is able to be raised by heat exchange of water with hot gaseous exhaust from the gas turbine or another gas turbine.

4 Claims, 1 Drawing Sheet

AIR SEPARATION PLANT

BACKGROUND OF THE INVENTION

This invention relates to air separation plant.

An air separation plant is often provided with a product compressor in addition to one or more air compressors. In large plants producing more than 1000 tonnes per day of product, separation is normally performed by rectification.

U.S. Pat. No. 4,382,366 relates to an air separation plant which produces an oxygen product. An oxygen product compressor is directly driven by a steam turbine. A waste nitrogen stream containing sufficient oxygen to support combustion is taken from the rectification column in which the oxygen product is separated and is without further compression introduced into a chamber in which combustion of a fuel gas takes place. The resultant combustion products are expanded in a turbo-expander. The steam supplied to the steam turbine is raised by heat exchange with the combustion gases exhausted from the air separation plant, the steam turbine and the turbo-compressor are all coupled together. Such a plant cannot produce a nitrogen product in large quantities.

The largest air separation plants may produce up to at least 10,000 tonnes per day of nitrogen product at elevated pressure. Accordingly, large product nitrogen compressors are required. Conventionally, such compressors are driven by electrical motors. Such electrical motors are often large and problems can arise in starting up the motors. Typically special start-up motors are provided.

It is the aim of the present invention to provide an air separation plant which does not require an electrical motor for either an air compressor or a product nitrogen compressor.

SUMMARY OF THE INVENTION

According to the present invention there is provided an air separation plant including an air compressor, a gas turbine arranged to drive the air compressor, a product nitrogen compressor and a steam turbine arranged to drive the product nitrogen compressor, wherein the steam turbine forms part of a circuit in which steam is able to be raised by heat exchange of water with hot gaseous exhaust from a gas turbine.

An air separation plant according to the invention offers a number of advantages. Firstly, the need for large electrical motors to drive the air compressor and the product compressor is obviated. Secondly, the steam cycle can be operated more efficiently than if the steam is raised directly by burning a fuel. Thirdly, if the pressure at which the product is required is likely to be changed over a period of time, driving the product nitrogen compressor by the steam turbine provides more flexibility for adjusting the product pressure than employing an electrical motor.

The gas turbine which is arranged to drive the air compressor is preferably the same gas turbine from which the said hot gaseous exhaust issues.

Preferably, the air separation plant additionally includes a further steam turbine adapted to start operation of the air compressor. The further steam turbine is preferably located in a start-up circuit including a boiler for supplying pressurised steam to the further steam turbine and a condenser for condensing expanded steam issuing from the further steam turbine.

The air separation plant typically additionally includes adsorption apparatus for removing water vapour and carbon dioxide from the compressed air, a heat exchanger for reducing the air to a temperature at which it is able to be separated by rectification, at least one rectification column separating nitrogen from the air, and at least one turbo-expander for generating refrigeration Preferably, the rectification column is a double rectification column comprising a higher pressure stage, a lower pressure stage, and condenser-reboiler thermally linking an upper region of the higher pressure stage to a lower region of the lower pressure stage, the arrangement being such that in operation the condenser provides reflux for both stages of the double rectification column. If desired, in order to maximise the average pressure at which nitrogen is taken from the rectification column, a stream of gaseous nitrogen may be taken from both the lower pressure stage and the higher pressure stage. In order to enhance the rate at which reflux is produced, part of the nitrogen vapour taken from the lower pressure stage may be condensed and fed back to the lower pressure stage. Necessary cooling for the additional condensation may be provided by taking a stream of oxygen containing liquid from the bottom of the lower pressure stage, reducing its pressure and thereby reducing its temperature, and heat exchanging the reduced pressure oxygen-enriched liquid stream with the nitrogen to be condensed.

BRIEF DESCRIPTION OF THE DRAWING

An air separation plant according to the invention will now be described by way of example with reference to the accompanying drawing, which is a schematic flow diagram of an air separation plant and associated power generation plant.

The drawing is not to scale.

DETAILED DESCRIPTION OF THE INVENTION

Figure 1:
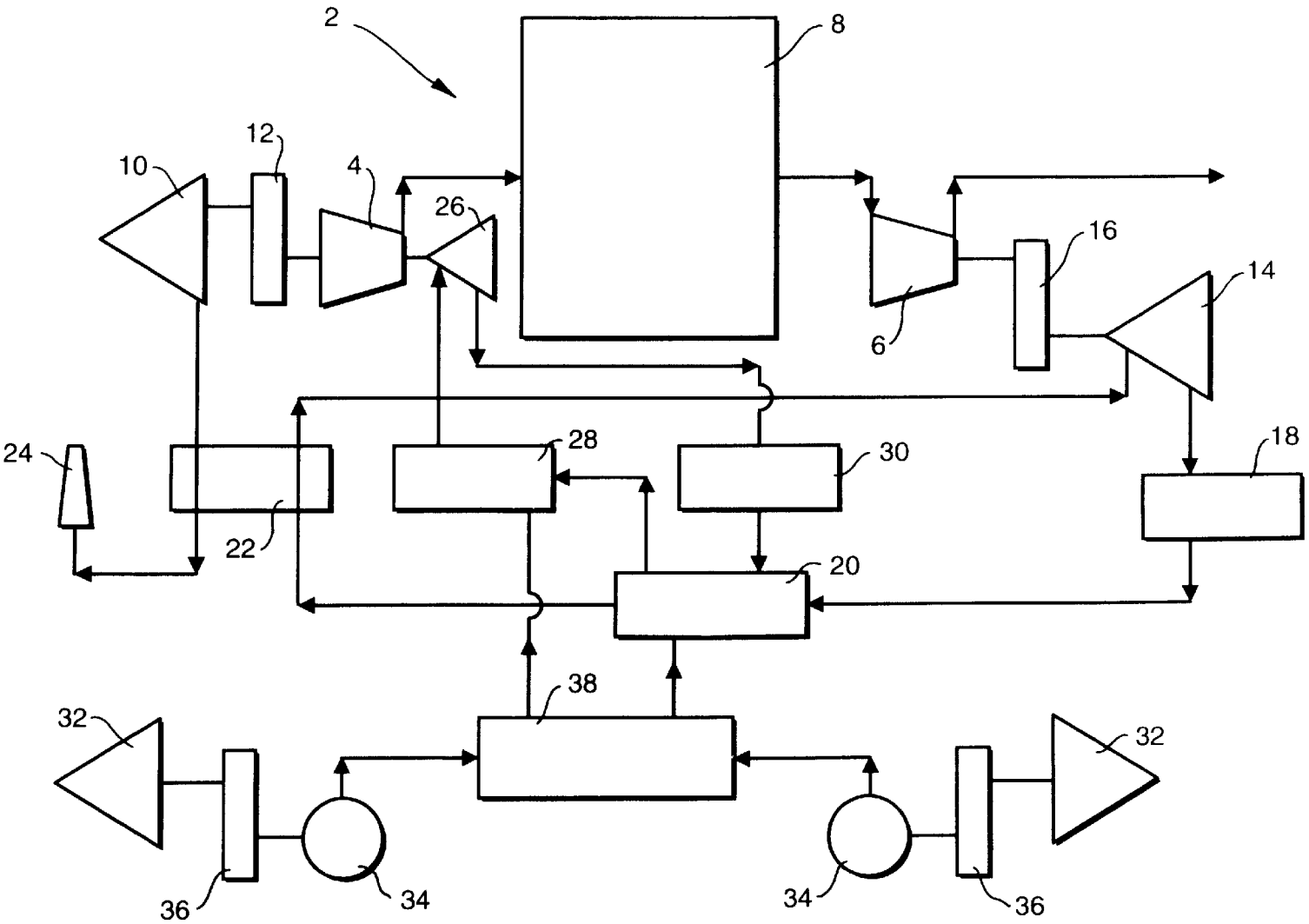

Referring to the drawing there is shown an air separation plant 2 for the separation of air by rectification. The plant 2 provides a nitrogen product at elevated pressure. It includes a main air compressor 4, typically comprising a plurality of compression stages, and a nitrogen product compressor 6, also typically comprising a plurality of compression stages. The remaining components of the air separation plant 2 are indicated by the reference numeral 8. For ease of illustration, the remaining parts are represented by a rectangular symbol and need not be described further herein. They are all well known, and the invention primarily concerns the operation of compressors 4 and 6.

In normal operation, the air compressor 4 is arranged to be driven by a gas turbine 10, preferably through an arrangement of gears 12. The components of the gas turbine 10 are not shown in FIG. 1 but typically comprise a separate air compressor, a combustion chamber having an inlet for air from the separate air compressor and an inlet for fuel gas, and a turbo-expander for expanding the combustion products issuing from the combustion chamber. The turbo-expander and the separate air compressor are typically mounted on the same shaft.

The product nitrogen compressor 6 is driven by a steam turbine 14, preferably through an arrangement of gears 16. The steam flows in a circuit of which the steam turbine 14 forms a part. Starting with the outlet for steam from the steam turbine 14, this circuit comprises a water condenser 18, a reservoir 20, a heat recover steam generator 22 and the inlet to the steam turbine 14. In operation, steam exhausted from the turbine 14 is condensed in the condenser 18 and fed to the reservoir 20. The water is pumped at an elevated pressure by means of a pump (not shown) to the steam generator 22 wherein superheated, pressurised steam is raised by indirect exchange of heat between the pressurised water and hot exhaust gases from the gas turbine 10. Downstream of its passage through the steam generator 22 the gaseous exhaust from the turbine 10 is vented into the atmosphere via a stack 24.

It typically takes several hours to start up the air separation plant and bring it to steady state operation. The nitrogen compressor 6 is therefore typically started after the air compressor 4. Accordingly, if the gas turbine 10 is employed to start up the air compressor 4, alternative arrangements to the steam generator 22 need to be made for cooling the hot combustion gases issuing from the outlet of the gas turbine 10. As shown in the drawing, the air compressor 4 is also operatively associated with a steam turbine 26. Steam turbine 26 is operated during the start-up period of the air separation plant 8 to drive the air compressor 4, either as shown, directly, or through an arrangement of gears (not shown). In order to generate steam for the steam turbine 26, a start-up boiler 28 is provided in which steam is raised to a desired temperature and pressure directly by the combustion of a suitable fuel, for example, natural gas. In addition, the steam turbine 26 also has a start-up condenser 30 associated with it for condensing steam exhausting from the steam turbine 26. The arrangement is that the boiler 28 receives water from the reservoir 20 and raises steam therefrom. The steam is expanded in the turbine 26 and the resulting expanded steam is condensed in the condenser 30 and returned to the reservoir 20. Typically an auxiliary pump (not shown) is employed to pass water under pressure from the reservoir 20 to the boiler 28.

Although the machines described above do not require any supply of electricity for the purposes of providing the necessary power to drive them, such a supply is typically required for the purposes of operating the water pumps (not shown) and for controlling operation of the boiler 28. The apparatus shown in the drawing may need to be operated on a site where there is no mains electricity supply. In order to generate the necessary electricity, a further gas turbine or gas turbines may be operated. As shown in the drawing, there are two further gas turbines 32. Each turbine drives an electrical generator 34 through an arrangement of gears 36. The generators 36 supply electrical power to an electrical system 38 adapted to supply electricity to the pumps (not shown) and other auxiliary systems associated with the apparatus shown in the drawings, as well as for other uses. In particular, it may be required in order to generate very large volumes of nitrogen for the enhanced recovery of oil to operate a plurality of plants of the same kind as shown in the drawing. The gas turbines 32 may be used to supply electrical power to the pumps and other auxiliary parts of these other plants.

Various changes and modifications may be made to the plant shown in the drawing. For example, in the enhanced recovery of oil or gas it is typically desired to have a source of nitrogen available at a pressure in excess of 100 bar. Typically, to provide such a pressure a further plural stage nitrogen compressor (not shown) is used in series with the product compressor 6 the further nitrogen compressor may also be driven by the steam turbine 14 via a separate arrangement of gears (not shown). Alternatively, a further steam turbine (not shown) may be provided for this purpose and may be fed with pressurised super-heated steam from the generator 20 and may return expanded steam to the condenser 18.

Typically, nitrogen is supplied to the product nitrogen compressor 6 at an elevated pressure in the range of 3 to 6 bar from the air separation plant 2. If desired, a further nitrogen stream may be supplied to an intermediate stage of the nitrogen compressor 6 from the air separation plant 2 at a pressure in excess of 10 bar.

I claim:

1. A system for use within an air separation plant for compressing air to be separated and for compressing product nitrogen produced by said air separation plant, said system including:

an air compressor;

a gas turbine arranged to drive the air compressor;

a product nitrogen compressor; and a steam turbine to drive the product nitrogen compressor, the steam turbine forming part of a circuit in which steam is raised by heat exchange of water with hot gaseous turbine exhaust.

2. The system plant as claimed in claim 1, in which the gas turbine which is arranged to drive the product nitrogen compressor is the same gas turbine from which the hot gaseous turbine exhaust issues.

3. The system plant as claimed in claim 1 additionally including a further steam turbine adapted to start operation of the air compressor.

4. The system plant as claimed in claim 3, wherein the further steam turbine is located in a start-up circuit including a boiler for supplying pressurised steam to the further steam turbine and a condenser for condensing expanded steam issuing from the further steam turbine.

* * * * *